US011035125B2

(12) United States Patent
Forte et al.

(10) Patent No.: US 11,035,125 B2
(45) Date of Patent: Jun. 15, 2021

(54) GUARD FOR CONTAINER

(71) Applicants: Douglas Forte, Dix Hills, NY (US); Gary Forte, Fort Salonga, NY (US)

(72) Inventors: Douglas Forte, Dix Hills, NY (US); Gary Forte, Fort Salonga, NY (US)

( * ) Notice: Subject to any disclaimer, the term of this patent is extended or adjusted under 35 U.S.C. 154(b) by 419 days.

(21) Appl. No.: 15/899,624

(22) Filed: Feb. 20, 2018

(65) Prior Publication Data

US 2018/0313092 A1 Nov. 1, 2018

Related U.S. Application Data

(60) Provisional application No. 62/602,548, filed on Apr. 28, 2017.

(51) Int. Cl.

| | |
|---|---|
| ***E04F 11/18*** | (2006.01) |
| ***E04F 11/16*** | (2006.01) |
| ***B65F 1/14*** | (2006.01) |

(52) U.S. Cl.

CPC ..... *E04F 11/1812* (2013.01); *B65F 1/141* (2013.01); *E04F 11/163* (2013.01); *E04F 11/1834* (2013.01); *E04F 11/1836* (2013.01); *E04F 11/1846* (2013.01); *E04F 2011/187* (2013.01); *E04F 2011/1821* (2013.01); *E04F 2011/1889* (2013.01)

(58) Field of Classification Search

CPC . E04F 11/163; E04F 11/1812; E04F 11/1834; E04F 11/1836; E04F 11/1846; E04F 2011/1821; E04F 2011/187; E04F 2011/1889; B65F 1/141; B65F 1/1426; B65F 1/006; A47F 10/04; E04H 17/18; E04G 21/3223

USPC ..... 256/65.14

See application file for complete search history.

(56) References Cited

U.S. PATENT DOCUMENTS 3,407,941 A * 10/1968 Schmidt ..... B65F 1/1426 211/84

3,924,913 A * 12/1975 Cooper ..... B65F 1/1426 312/258

(Continued)

OTHER PUBLICATIONS

NationalCart.com, National Cart Products | Metal Covered Cart Corral, Feb. 29, 2016 <https://web.archive.org/web/20160229135812/http://www.nationalcart.com/dt_catalog/metal-covered-cart-corral/> (Year: 2016).*

*Primary Examiner* — Amber R Anderson
*Assistant Examiner* — Alexus Camero
(74) *Attorney, Agent, or Firm* — Scully, Scott, Murphy & Presser, P.C.

(57) ABSTRACT

The guard includes a left side extension operably connected to a left segment, the left segment operably connected to a left corner, the left corner operably connected to a middle segment, the middle segment operably connected to a right corner, the right corner operably connected to a right segment, the right segment operably connected to a right extension, wherein each of the left segment, the middle segment and the right segment comprise at least one support maintaining a distance of each of the left segment, the middle segment and the right segment from a supporting surface, and wherein the left segment, the middle segment and the right segment are configured to form a first opening, the first opening so dimensioned and configured as to accept insertion of a first container.

20 Claims, 6 Drawing Sheets

(56) References Cited

U.S. PATENT DOCUMENTS

| | | | | | |
|---|---|---|---|---|---|
| 4,609,183 | A * | 9/1986 | Ulmer | A47F 10/04 | 256/1 |
| D333,873 | S * | 3/1993 | McCue | D25/38.1 | |
| 5,201,426 | A * | 4/1993 | Cruwell, Jr. | A47F 10/04 | 211/17 |
| 5,862,921 | A * | 1/1999 | Venegas, Jr. | A47F 10/04 | 211/17 |
| 5,891,534 | A * | 4/1999 | Sabin | A47B 96/02 | 42/11 |
| 6,298,997 | B1 * | 10/2001 | Jarrett | A47F 10/04 | 211/17 |
| 6,477,972 | B2 * | 11/2002 | Perkins | E02D 29/12 | 114/201 R |
| 6,688,046 | B2 * | 2/2004 | Perkins | E02D 29/127 | 256/65.01 |
| 8,668,186 | B1 * | 3/2014 | Wagner | B65F 1/1426 | 256/25 |
| 8,702,069 | B1 * | 4/2014 | Byers | E04F 11/1812 | 256/65.14 |

* cited by examiner

GUARD FOR CONTAINER

CROSS REFERENCE TO RELATED APPLICATIONS

The present application claims benefit of U.S. Provisional Application No. 62/602,548, filed on Apr. 28, 2017, the entire contents of which are incorporated herein by reference.

BACKGROUND OF THE DISCLOSURE

Typical container enclosures can be damaged by the movement of containers during servicing and through impacts from various vehicles. Damage typically occurs because the containers are able to move freely throughout the enclosure and can be oriented in many different directions.

What is desired is a device and method for using a device that can provide a way to protect an enclosure. Embodiments of the present disclosure provide methods that address the above and other issues.

SUMMARY OF THE DISCLOSURE

The present disclosure is directed to a guard. The guard includes a left side extension operably connected to a left segment, the left segment operably connected to a left corner, the left corner operably connected to a middle segment, the middle segment operably connected to a right corner, the right corner operably connected to a right segment, the right segment operably connected to a right extension, wherein each of the left segment, the middle segment and the right segment comprise at least one support maintaining a distance of each of the left segment, the middle segment and the right segment from a supporting surface, and wherein the left segment, the middle segment and the right segment are configured to form a first opening, the first opening so dimensioned and configured as to accept insertion of a first container.

BRIEF DESCRIPTION OF THE DRAWINGS

The present disclosure will be better understood by reference to the following drawings of which.

DETAILED DESCRIPTION OF THE DISCLOSURE

Figure 1:
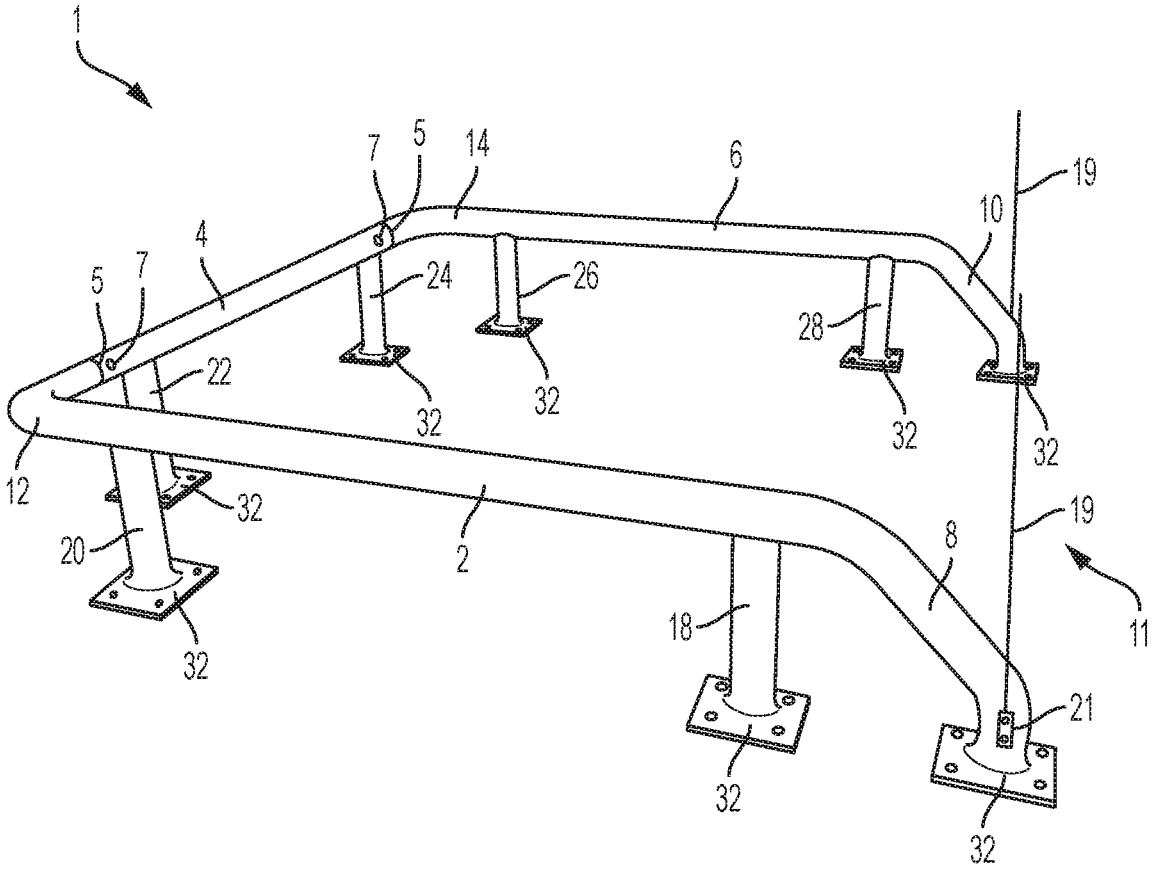
FIG. 1 is a perspective view of an embodiment of a guard.

The present application will now be described in greater detail by referring to the following discussion and drawings that accompany the present application. It is noted that the drawings of the present application are provided for illustrative purposes only and, as such, the drawings are not drawn to scale. It is also noted that like and corresponding elements are referred to by like reference numerals.

In the following description, numerous specific details are set forth, such as particular structures, components, materials, dimensions, processing steps and techniques, in order to provide an understanding of the various embodiments of the present application.

However, it will be appreciated by one of ordinary skill in the art that the various embodiments of the present application may be practiced without these specific details. In other instances, well-known structures or processing steps have not been described in detail in order to avoid obscuring the present application.

It will be understood that when an element as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "beneath" or "under" another element, it can be directly beneath or under the other element, or intervening elements may be present. In contrast, when an element is referred to as being "directly beneath" or "directly under" another element, there are no intervening elements present.

In the discussion and claims herein, the term "about" indicates that the value listed may be somewhat altered, as long as the alteration does not result in nonconformance of the process or structure to the illustrated embodiment. For example, for some elements the term "about" can refer to a variation of +0.1%, for other elements, the term "about" can refer to a variation of ±1% or ±10%, or any point therein.

As used herein, the term "substantially", or "substantial", is equally applicable when used in a negative connotation to refer to the complete or near complete lack of an action, characteristic, property, state, structure, item, or result. For example, a surface that is "substantially" flat would either be completely flat, or so nearly flat that the effect would be the same as if it were completely flat.

As used herein terms such as "a", "an" and "the" are not intended to refer to only a singular entity, but include the general class of which a specific example may be used for illustration.

As used herein, terms defined in the singular are intended to include those terms defined in the plural and vice versa.

Reference herein to any numerical range expressly includes each numerical value (including fractional numbers and whole numbers) encompassed by that range. To illustrate, reference herein to a range of "at least 50" or "at least about 50" includes whole numbers of 50, 51, 52, 53, 54, 55, 56, 57, 58, 59, 60, etc., and fractional numbers 50.1, 50.2 50.3, 50.4, 50.5, 50.6, 50.7, 50.8, 50.9, etc. In a further illustration, reference herein to a range of "less than 50" or "less than about 50" includes whole numbers 49, 48, 47, 46, 45, 44, 43, 42, 41, 40, etc., and fractional numbers 49.9, 49.8, 49.7, 49.6, 49.5, 49.4, 49.3, 49.2, 49.1, 49.0, etc. In yet another illustration, reference herein to a range of from "5 to 10" includes whole numbers of 5, 6, 7, 8, 9, and 10, and fractional numbers 5.1, 5.2, 5.3, 5.4, 5.5, 5.6, 5.7, 5.8, 5.9, etc.

As used herein the term "tubular" refers to an elongate article having an internal chamber running substantially along the length thereof. In some embodiment the internal chamber is open or substantially open, such that the tubular element is substantially hollow. In some embodiments, the internal chamber is filled, or substantially filled, such that the tubular element is substantially solid.

While it is expected that the tubular elements of the present disclosure can have a substantially circular cross-sectional configuration, it is contemplated that other cross-sectional configurations, such as substantially triangular, substantially rectangular, substantially pentagonal (including other geometric shapes with 6, 7 or more sides) and substantially ellipsoidal or erratic shapes, may also be used.

As used herein the term "container" refers to any refuse and/or recycling receptacle, such as a dumpster, can, canister and/or bin of any volume from about 50 gallons to about 40 yards, also including the non-limiting list of example volumes: 2 yards, 4 yards, 6 yards, 8 yards, 10 yards, 15 yards, 20 yards, 25 yards and 30 yards. The container of this disclosure can be any suitable shape, including a substantially rectangular cross-section, and can include a flat and/or slanted covering extending over a portion of or the whole top of the container.

One embodiment of a guard 1 for a container is shown in FIG. 1.

The guard 1 is substantially three sided, with an opening between two of the sides allowing for entry and removal of a container. The guard 1 can include a left segment 2 operably connected to a middle segment 4, and the middle segment 4 operably connected to a right segment 6.

Each of the left segment 2, middle segment 4 and right segment 6 can be formed of the same, or different materials, including plastic, metal (including steel, aluminum, iron and mixtures thereof), rubber, carbon based materials, and mixtures thereof. Each of the left segment 2, middle segment 4 and right segment 6 can be the same, or different diameters or circumferences, ranging from about 0.5" diameter, to about 6" diameter or larger, also including the non-limiting list of example diameters: 1", 1.5", 2", 2.5", 3" 3.5", 4", 4.5", 5" and 5.5".

Operably connected to one end of the left segment 2 is left side extension 8. Left side extension 8 is at an angle relative to left segment 2, the angle being in the range of about 30° to about 60°, or about 40° to about 50°, or about 45°. Similarly, operably connected to one end of the right segment 6 is right side extension 10. Right side extension 10 is at an angle relative to right segment 6, the angle being in the range of about 30° to about 60°, or about 40° to about 50°, or about 450°.

The left segment 2 is operably connected to the middle segment 4 by a left corner 12, the left corner 12 having a radius of curvature. In other embodiments left corner 12 can be angular.

The right segment 6 is operably connected to the middle segment 4 by a right corner 14, the right corner 14 having a radius of curvature. In other embodiments right corner 14 can be angular.

In this embodiment left side extension 8, left segment 2, left corner 12, middle segment 4, right corner 14, right segment 6 and right side extension 10 can be formed of a single length of material, or two or more pieces of material joined together. Also, left side extension 8, left segment 2, left corner 12, middle segment 4, right corner 14, right segment 6 and right side extension 10 form an opening 11 that is so dimensioned and configured as to accept insertion of a container (shown in FIG. 2 below), holding and maintaining the container within the opening formed by the guard 1.

In this embodiment, left side extension 8, left segment 2 and left corner 12 are formed of a single length of material, and joined to middle segment 4 at splice 5. Left side extension 8, left segment 2 and left corner 12 can be joined to middle segment 4 at splice 5 in any suitable way, such as by a bolt 7. Further, in this embodiment, right corner 14, right segment 6 and right side extension 10 are formed of a single length of material, and are joined to middle segment 4.

Operably connected to the left segment 2, are first support 18 and second support 20. Operably connected to the middle segment 4 are third support 22 and fourth support 24. Operably connected to the right segment 6 are fifth support 26 and sixth support 28. Although each of the six supports are illustrated nearer the ends of the three segments, in other embodiments, the guard 1 can include five or fewer supports in varying locations along the segments or corners.

Each of the first support 18, second support 20, third support 22, fourth support 24, fifth support 26 and sixth support 28 are substantially perpendicular to each of the left segment 2, middle segment 4 and the right segment 6. Also, at an end of each of the supports opposing the segments, a securing plate 32 is affixed. Securing plate 32 allows for the guard to be secured to one location through any suitable mechanical and/or adhesive means, such as by bolting the securing plates to an underlying material.

As can be seen in FIG. 1, left segment 2 extends a distance past first support 18 at the same angle, then contacts left side extension 8. Also, right segment 6 extends a distance past sixth support 28 at the same angle, then contacts right side extension 10.

Also shown in FIG. 1 is an optional marker 19 that, in this embodiment, is affixed to left side extension 8. In other embodiments the marker 19 can be attached to any portion of the guard 1, at any suitable location. Marker 19 extends a distance vertically above an upper surface of the guard 1, and can be used to enhance the visibility of the guard for operators of motor vehicles and plows. Each of the guards in the present application can include one or more optional markers that extend from a portion of the guard a vertical height.

Marker 19 is operably attached to the guard 1 by an attachment tube 21. Attachment tube 21 can be operably attached to the guard 1 in any suitable way, such as by welding. The marker 19 can be configured to fit within a portion of the attachment tube 21 to maintain marker 19's position.

Figure 2:
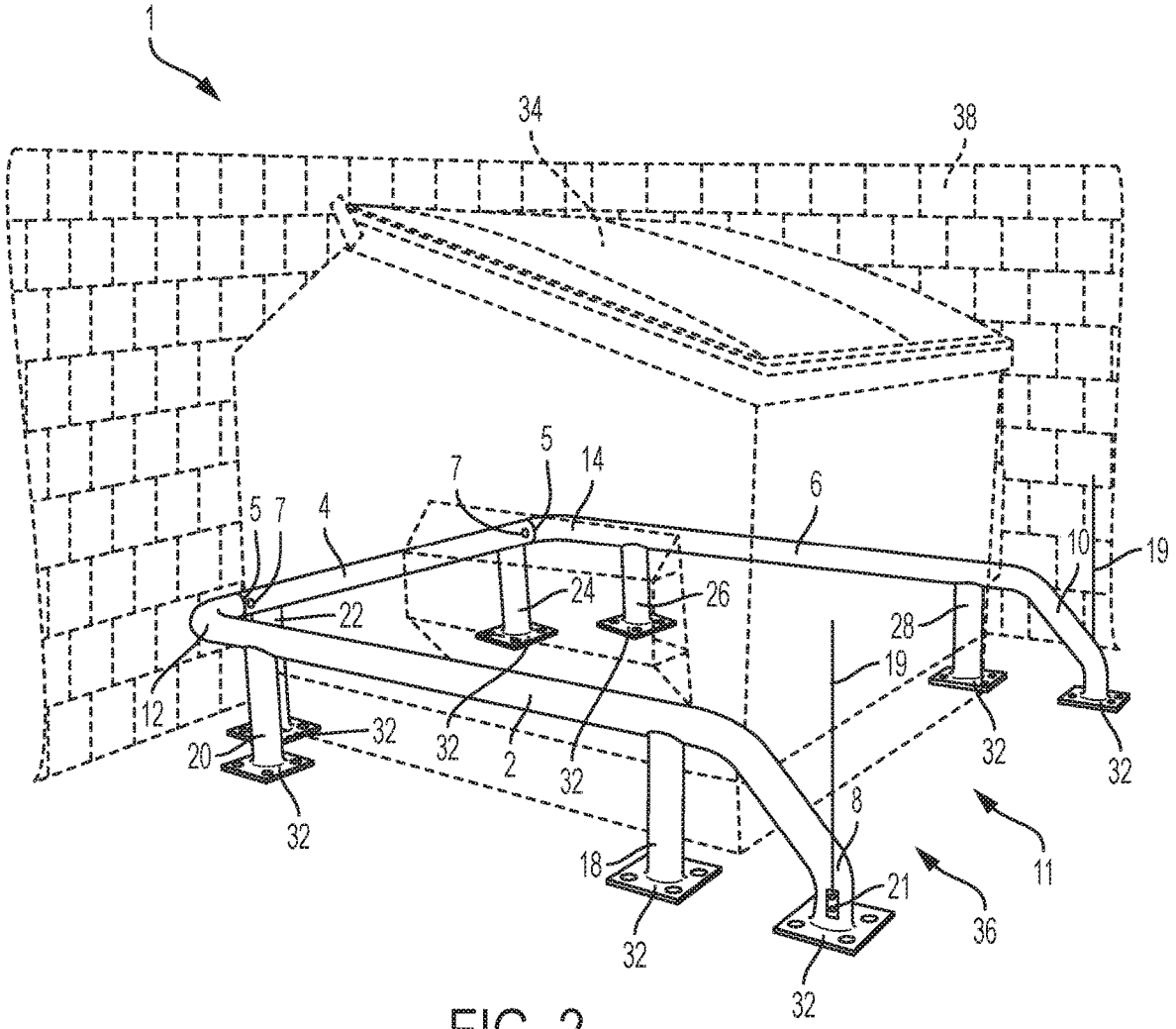
FIG. 2 is a perspective view of an embodiment of a guard, together with a container and enclosure.

A container 34 is shown together with guard 1 in FIG. 2. Also as seen in FIG. 2, a supporting surface 36 is included, as well as an enclosure 38. Portions of the container 34, and portions of the enclosure 138 are shown as being transparent for illustrative purposes.

As can be seen from FIG. 2, guard 1 is so dimensioned and configured as to accept insertion of the container 34. In FIG. 2 a separation distance is so dimensioned and configured so as to prevent or substantially prevent contact between the container 34 and the enclosure 38 during all movement of the container 34, such as movement of the container 34 associated with unloading the container 34 and replacing the container 34 back into the enclosure 38 after emptying. In this disclosure enclosure 38 is shown as including three walls, but in other embodiments, enclosure 38 can be in any other suitable orientation and can include one wall, two walls, four walls or more, at varying angles to each other.

Figure 3:
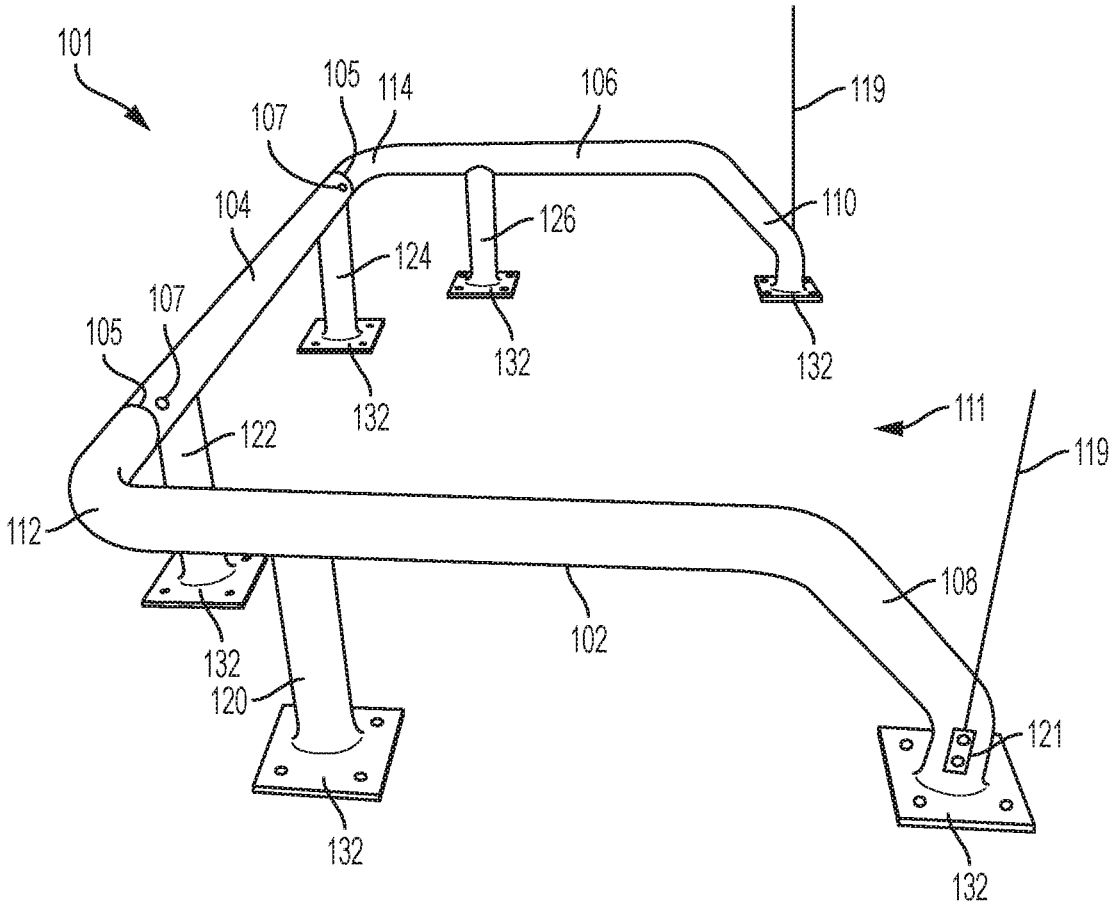
FIG. 3 is a perspective view of an embodiment of a guard.

Another embodiment of a guard 101 for a container is shown in FIG. 3.

The guard 101 is substantially three sided, with an opening between two of the sides allowing for entry and removal of a container, typically a container that is relatively smaller than one for guard 1 of FIG. 1. In FIG. 3, the guard 101 can include a left segment 102 operably connected to a middle segment 104, and the middle segment 104 operably connected to a right segment 106.

This embodiment includes an optional marker 119 that, in this embodiment, is affixed to left side extension 108. In other embodiments the marker 119 can be attached to any portion of the guard 101, at any suitable location. Marker 119 extends a distance vertically above an upper surface of the guard 101, and can be used to enhance the visibility of the guard for operators of motor vehicles and plows. Each of the guards in the present application can include one or more optional markers that extend from a portion of the guard a vertical height.

Marker 119 is operably attached to the guard 101 by an attachment tube 121. Attachment tube 121 can be operably attached to the guard 101 in any suitable way, such as by welding. The marker 119 can be configured to fit within a portion of the attachment tube 121 to maintain marker 119's position.

Each of the left segment 102, middle segment 104 and right segment 106 can be formed of the same, or different materials, including plastic, metal (including steel, aluminum, iron and mixtures thereof), rubber, carbon based materials, and mixtures thereof. Each of the left segment 102, middle segment 104 and right segment 106 can be the same, or different diameters or circumferences, ranging from about 0.5" diameter, to about 6" diameter or larger, also including the non-limiting list of example diameters: 1", 1.5", 2", 2.5", 3" 3.5", 4", 4.5", 5" and 5.5".

Operably connected to one end of the left segment 102 is left side extension 108.

Left side extension 108 is at an angle relative to left segment 102, the angle being in the range of about 30° to about 60°, or about 40° to about 50°, or about 45°. Similarly, operably connected to one end of the right segment 106 is right side extension 110. Right side extension 110 is at an angle relative to right segment 106, the angle being in the range of about 30° to about 60°, or about 40° to about 50°, or about 45°.

The left segment 102 is operably connected to the middle segment 104 by a left corner 112, the left corner 112 having a radius of curvature. In other embodiments left corner 112 can be angular.

The right segment 106 is operably connected to the middle segment 104 by a right corner 114, the right corner 114 having a radius of curvature. In other embodiments right corner 114 can be angular.

In this embodiment left side extension 108, left segment 102, left corner 112, middle segment 104, right corner 114, right segment 106 and right extension 110 can be formed of a single length of material, or two or more pieces of material joined together.

Also, left side extension 108, left segment 102, left corner 112, middle segment 104, right corner 114, right segment 106 and right extension 110 form an opening 111 that is so dimensioned and configured as to accept insertion of a container (shown in FIG. 4 below), holding and maintaining the container within the opening formed by the guard 101.

In this embodiment left side extension 108, left segment 102, left corner 112, middle segment 104, right corner 114, right segment 106 and right side, extension 110 can be formed of a single length of material, or two or more pieces of material joined together.

Also, left side extension 108, left segment 102, left corner 112, middle segment 104, right corner 114, right segment 106 and right side extension 110 form an opening 111 that is so dimensioned and configured as to accept insertion of a container (shown in FIG. 4 below), holding and maintaining the container within the opening formed by the guard 101.

In this embodiment, left side extension 108, left segment 102 and left corner 112 are formed of a single length of material, and joined to middle segment 104 at splice 105. Left side extension 108, left segment 102 and left corner 112 can be joined to middle segment 104 at splice 105 in any suitable way, such as by a bolt 107. Further, in this embodiment, right corner 114, right segment 106 and right side extension 110 are formed of a single length of material, and are joined to middle segment 104.

Operably connected to the left segment 102 is first support 120. Operably connected to the middle segment 104 are second support 122 and third support 124. Operably connected to the right segment 106 is fourth support 126. Although each of the four supports are illustrated nearer the ends of the three segments, in other embodiments, the guard 101 can include three or fewer supports in varying locations along the segments or corners.

Each of the first support 120, second support 122, third support 124 and fourth support 126 are substantially perpendicular to each of the left segment 102, middle segment 104 and the right segment 106. Also, at an end of each of the supports opposing the segments, a securing plate 132 is affixed. Securing plate 132 allows for the guard to be secured to one location through any suitable mechanical and/or adhesive means, such as by bolting the securing plates to an underlying material.

Figure 4:
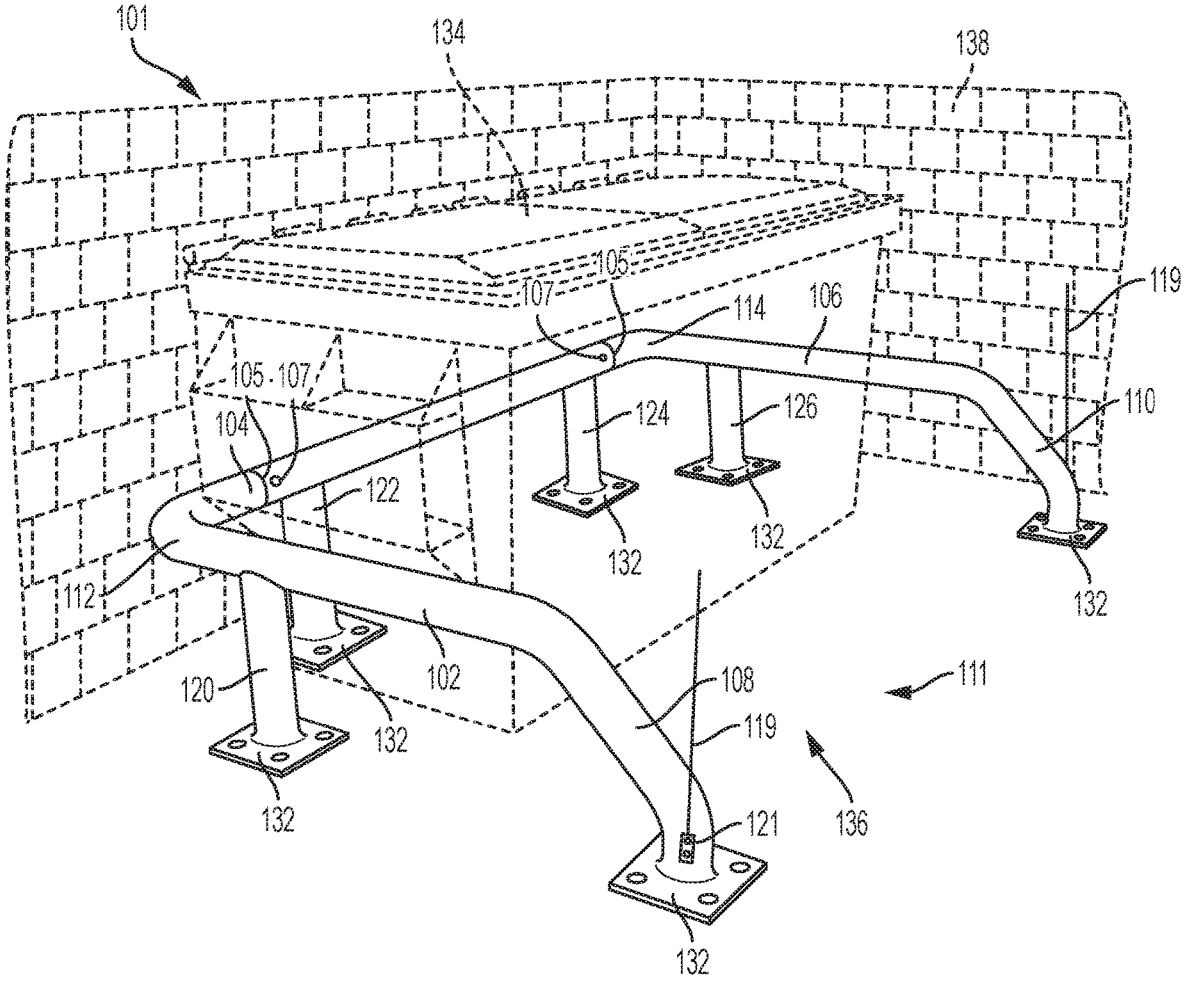
FIG. 4 is a perspective view of an embodiment of a guard, together with a container and enclosure.

A container 134 is shown together with guard 101 in FIG. 4. Also as seen in FIG. 4, a supporting surface 136 is included, as well as an enclosure 138. Portions of the container 134, and portions of the enclosure 138 are shown as being transparent for illustrative purposes.

As can be seen from FIG. 4, guard 101 is so dimensioned and configured as to accept insertion of the container 134. In FIG. 4 a separation distance is so dimensioned and configured to so as to prevent or substantially-prevent contact between the container 134 and the enclosure 138 during all movement of the container 134, such as movement of the container 134 associated with unloading the container 134 and replacing the container 134 back into the enclosure 138 after emptying.

Figure 5:
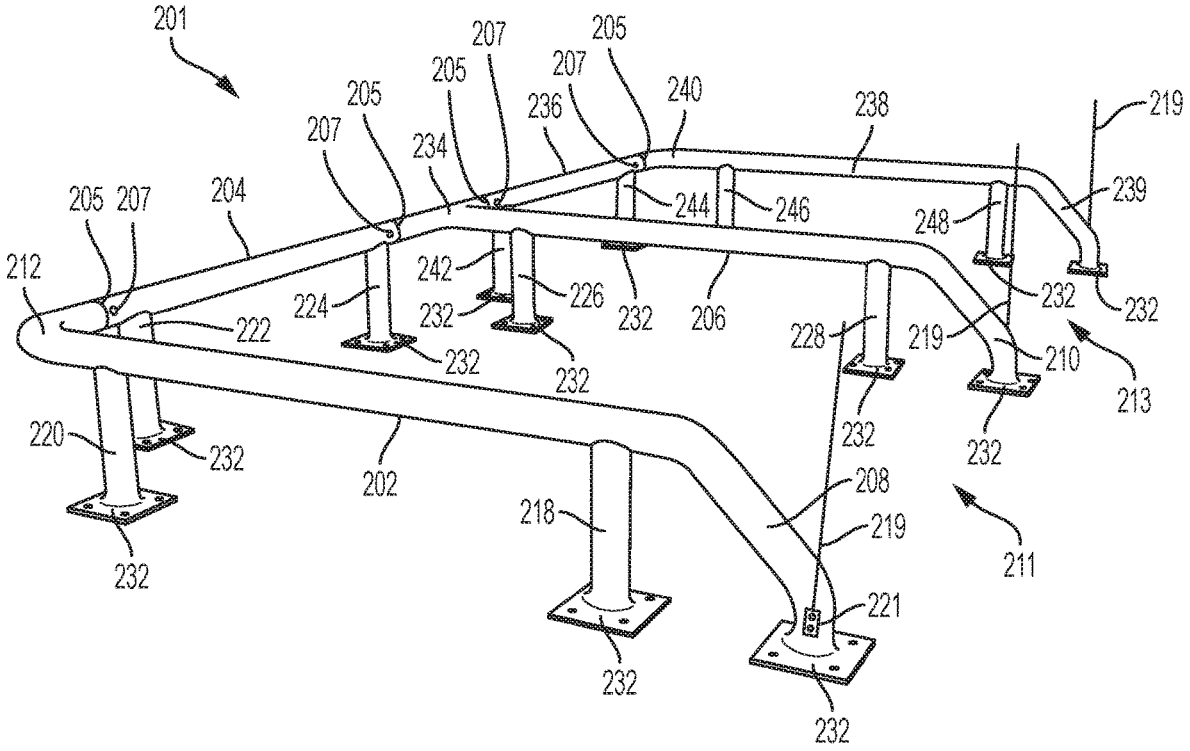
FIG. 5 is a perspective view of an embodiment of a guard.

Another embodiment of a guard 201 for a container is shown in FIG. 5.

The guard 201 is substantially five sided, with two openings between three of the sides allowing for entry and removal of two containers. In FIG. 5, the guard 201 can include a left segment 202 operably connected to a middle segment 204, and the middle segment 204 operably connected to a right segment 206. The guard 201 can further include an expansion middle segment 236 operably connected to the middle segment 204 and an expansion right segment 238 operably connected to the expansion middle segment 236.

This embodiment includes an optional marker 219 that, in this embodiment, is affixed to left side extension 208. In other embodiments the marker 219 can be attached to any portion of the guard 201, at any suitable location. Marker 219 extends a distance vertically above an upper surface of the guard 201, and can be used to enhance the visibility of the guard for operators of motor vehicles and plows. Each of the guards in the present application can include one or more optional markers that extend from a portion of the guard a vertical height.

Marker 219 is operably attached to the guard 201 by an attachment tube 221.

Attachment tube 221 can be operably attached to the guard 201 in any suitable way, such as by welding. The marker 219 can be configured to fit within a portion of the attachment tube 221 to maintain marker 219's position.

Each of the left segment 202, middle segment 204, right segment 206, expansion middle segment 236 and expansion right segment 238 can be formed of the same, or different materials, including plastic, metal (including steel, aluminum, iron and mixtures thereof), rubber, carbon based materials, and mixtures thereof. Each of the left segment 202, middle segment 204, right segment 206, expansion middle segment 236 and expansion right segment 238 can be the same, or different diameters or circumferences, ranging from about 0.5" diameter, to about 6" diameter or larger, also including the non-limiting list of example diameters: 1", 1.5", 2", 2.5", 3" 3.5", 4", 4.5", 5" and 5.5".

Operably connected to one end of the left segment 202 is left side extension 208. Left side extension 208 is at an angle relative to left segment 202, the angle being in the range of about 30° to about 60°, or about 40° to about 50°, or about 45°. Similarly, operably connected to one end of the right segment 206 is right side extension 210. Right side extension 210 is at an angle relative to right segment 206, the angle being in the range of about 30° to about 60°, or about 40° to about 50°, or about 45°. Similarly, operably connected to one end of the expansion right segment 238 is expansion right side extension 239. Expansion right side extension 239 is at an angle relative to expansion right segment 238, the angle being in the range of about 30° to about 60°, or about 40° to about 50°, or about 45°.

The left segment 202 is operably connected to the middle segment 204 by a left corner 212, the left corner 212 having a radius of curvature. In other embodiments left corner 212 can be angular.

The right segment 206 and the expansion middle segment 236 are operably connected to the middle segment 204 by a T-connector 234. In this embodiment T-connector 234 is shown as being angular, but in embodiments, portions of T-connector 234 can have a radius of curvature.

The right expansion segment 238 is operably connected to the expansion middle segment 236 by an expansion corner 240, the expansion corner having a radius of curvature. In other embodiments, expansion corner 240 can be angular.

In this embodiment left side extension 208, left segment 202, left corner 212, middle segment 204, T-connector 234, right segment 206, right side extension 210, expansion middle segment 236, expansion corner 240, expansion right segment 238 and expansion right side extension 239 can be formed of a single length of material, or two or more pieces of material joined together.

In this embodiment, left side extension 208, left segment 202 and left corner 212 are formed of a single length of material, and joined to middle segment 204 at splice 205. Left side extension 208, left segment 202 and left corner 212 can be joined to middle segment 204 at splice 205 in any suitable way, such as by a bolt 207. Further, in this embodiment, T-connector 234, right segment 206 and right side extension 210 are formed of a single length of material, and are joined to middle segment 204.

Also, left side extension 208, left segment 202, left corner 212, middle segment 204, T-connector 234, right segment 206, right side extension 210, expansion middle segment 236, expansion corner 240, expansion right segment 238 and expansion right side extension 239 form two openings 211 and 213 that are so dimensioned and configured as to accept insertion of two containers (shown in FIG. 6 below), holding and maintaining the containers within the opening formed by the guard 201.

Operably connected to the left segment 202, are first support 218 and second support 220. Operably connected to the middle segment 204 are third support 222 and fourth support 224. Operably connected to the right segment 206 are fifth support 226 and sixth support 228. Operably connected to the expansion middle segment 236 are seventh support 242 and eighth support 244. Operably connected to the expansion right segment 238 are ninth support 246 and tenth support 248. Although each of the ten supports are illustrated nearer the ends of the five segments, in other embodiments, the guard 201 can include nine or fewer supports in varying locations along the segments, connectors or corners.

Each of the first support 218, second support 220, third support 222, fourth support 224, fifth support 226, sixth support 228, seventh support 242, eighth support 244, ninth support 246 and tenth support 248 are substantially perpendicular to each of the left segment 202, middle segment 204, the right segment 206, the expansion middle section 236 and the expansion right segment 238. Also, at an end of each of the supports opposing the segments, a securing plate 232 is affixed. Securing plate 232 allows for the guard to be secured to one location through any suitable mechanical and/or adhesive means, such as by bolting the securing plates to an underlying material.

Figure 6:
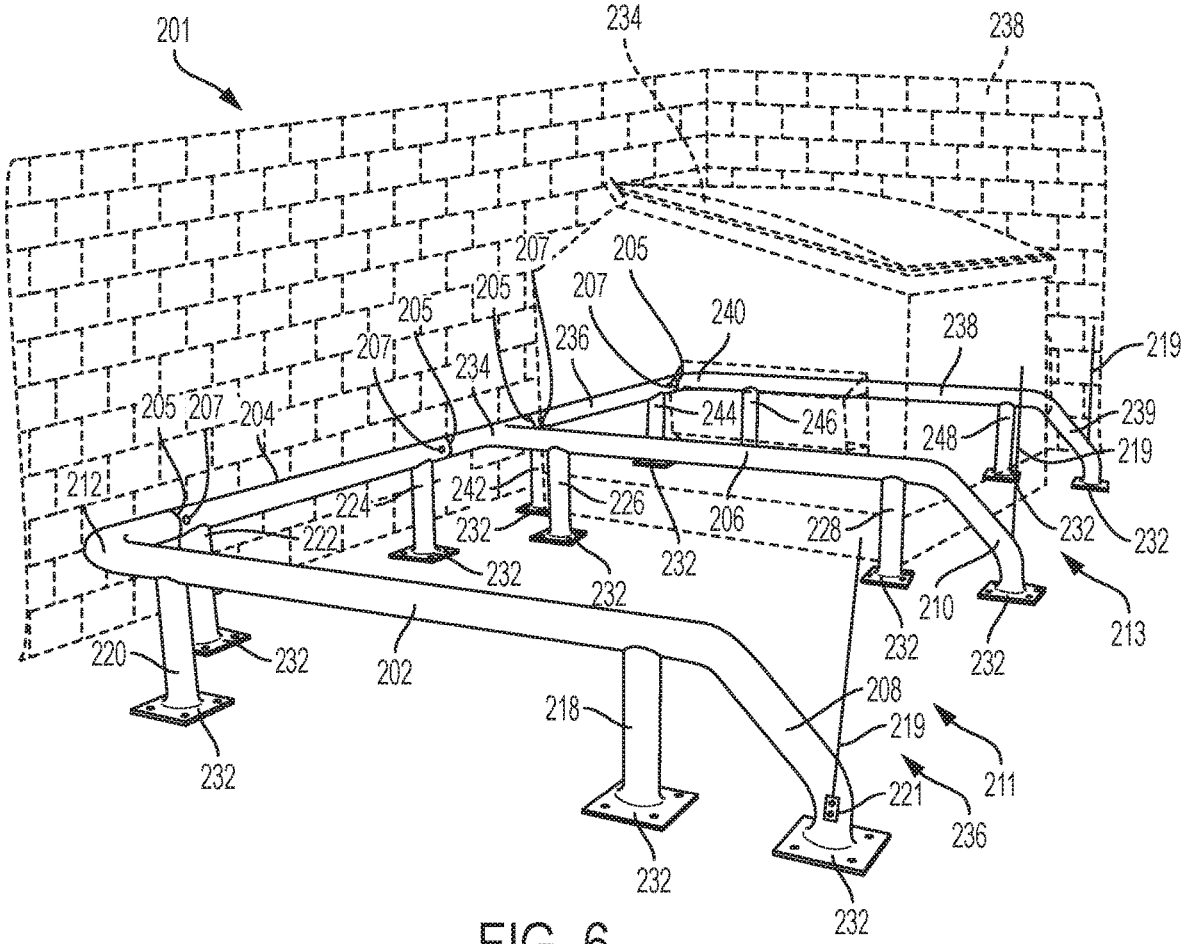
FIG. 6 is a perspective view of an embodiment of a guard, together with two containers and enclosure.

Container 234 is shown together with guard 201 in FIG. 6. Also as seen in FIG. 6, a supporting surface 236 is included, as well as an enclosure 238. Portions of the container 234, and portions of the enclosure 238 are shown as being transparent for illustrative purposes.

Although guard 201 is shown as including a container 234, guard 201 can be expanded to include three, four or more containers, as desired. As an example of a guard that can accept three containers, the guard 201 can have the expansion corner 240 removed and replaced with a T-connector, similar to T-connector 234. A further expansion middle segment (similar to expansion middle segment 236), a further expansion corner (similar to expansion corner 240), a further expansion right segment (similar to expansion right segment 238) and a further expansion right side extension (expansion right side extension 239) can be added to guard 201. Each of these additional expansion elements can include one or more supports (similar to supports 242, 244, 246 and 248) with associated securing plates (such as securing plate 232).

This description of adding elements to guard 201 to accept three containers can be repeated multiple times to expand the guard to accept as many containers as desired.

As can be seen from FIG. 6, guard 201 is so dimensioned and configured as to accept insertion of container 234. In FIG. 6, a separation distance is so dimensioned and configured to so as to prevent or substantially prevent contact between containers and the enclosure 238 during all movement of the container 234, such as movement of the container 234 associated with unloading the container 234 and replacing the container 234 back into the enclosure 238 after emptying.

The described embodiments and examples of the present disclosure are intended to be illustrative rather than restrictive, and are not intended to represent every embodiment or example of the present disclosure. While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. Further, various modifications and variations can be made without departing from the spirit or scope of the disclosure as set forth in the following claims both literally and in equivalents recognized in law.

The invention claimed is:

1. A guard comprising:

a left side extension operably connected to a left segment;

the left segment operably connected to a left corner;

the left corner operably connected to a middle segment;

the middle segment operably connected to a right corner;

the right corner operably connected to a right segment; and the right segment operably connected to a right side extension, wherein the left side extension is at an angle relative to the left segment of about 30° to about 60°, and the right side extension is at an angle relative to the right segment of about 30° to about 60°, wherein each of the left segment, the middle segment and the right segment comprise at least one support maintaining a distance of each of the left segment, the middle segment and the right segment from a supporting surface, and wherein the middle segment comprises a first middle support and a second middle support, and wherein the left segment comprises a first left support and the right segment comprises a first right support, wherein a distance between the first middle support and the second middle support is smaller than a distance between the first left support and the first right support, wherein the left segment, the middle segment and the right segment are configured to form a first opening, the first opening so dimensioned and configured as to accept insertion of a first container, and wherein each of the left side extension, the right side extension, and the support of each of the left segment, the middle segment and the right segment comprise respective securing plates configured to secure the guard to the supporting surface.

2. The guard of claim 1, wherein the left side extension and the right side extension contact the supporting surface.

3. The guard of claim 1, wherein each of the left segment and the right segment comprise at least two supports maintaining a distance of each of the left segment and the right segment from the supporting surface.

4. The guard of claim 1, wherein the right corner is T-shaped.

5. The guard of claim 4, the guard further comprising an expansion middle segment operably connected to the right corner, the expansion middle segment operably connected to an expansion corner, the expansion corner operably connected to an expansion right segment, the expansion right segment operably connected to an expansion right side extension, wherein the right segment, the expansion middle segment and the expansion right segment are configured to form a second opening, the second opening so dimensioned and configured as to accept insertion of a second container.

6. The guard of claim 5, wherein the expansion middle segment and the expansion right segment comprise at least one support maintaining a distance of each of the expansion middle segment and the expansion right segment from the supporting surface.

7. The guard of claim 5, wherein the expansion right side extension contacts the supporting surface.

8. The guard of claim 1, wherein the guard is configured to maintain a distance between the first container and an enclosure.

9. The guard of claim 5, wherein the guard is configured to maintain a distance between the first container and an enclosure and between the second container and the enclosure.

10. The guard of claim 1, wherein the first opening is so dimensioned and configured as to accept insertion of the first container, wherein the first container is a volume selected from the group consisting of 2 yards, 4 yards, 6 yards, 8 yards, 10 yards, 15 yards, 20 yards, 25 yards and 30 yards.

11. A guard comprising:

a left side extension operably connected to a left segment;

the left segment operably connected to a left corner;

the left corner operably connected to a middle segment;

the middle segment operably connected to a right corner;

the right corner operably connected to a right segment;

the right segment operably connected to a right side extension, wherein the left side extension, the left segment, and the left corner are formed of a first, single length of material, and wherein the right corner, the right segment and the right side extension are formed of a second, single length of material, wherein each of the left segment, the middle segment and the right segment comprise at least one support maintaining a distance of each of the left segment, the middle segment and the right segment from a supporting surface, wherein each of the support of each of the left segment, the middle segment and the right segment comprise a securing plate configured to secure the guard to the supporting surface wherein each securing plate extends around a circumference of the respective left segment, middle segment and right segment, wherein the left segment, the middle segment and the right segment are configured to form a first opening, the first opening so dimensioned and configured as to accept insertion of a first container, wherein the at least one support of the left segment is spaced a distance away, towards the at least one support of the right segment, from an apex of the left corner, wherein the at least one support of the right segment is spaced a distance away, towards the at least one support of the left segment, from an apex of the right corner, wherein the left corner and the right corner are configured such that the middle segment is shorter than a width of the first opening, and wherein the middle segment comprises a first middle support and a second middle support, and wherein the left segment comprises a first left support and the right segment comprises a first right support, wherein a distance between the first middle support and the second middle support is smaller than a distance between the first left support and the first right support.

12. The guard of claim 11, wherein each of the left segment and the right segment comprise at least two supports maintaining a distance of each of the left segment and the right segment from the supporting surface.

13. The guard of claim 11, wherein the right corner is T-shaped.

14. The guard of claim 13, the guard further comprising an expansion middle segment operably connected to the right corner, the expansion middle segment operably connected to an expansion corner, the expansion corner operably connected to an expansion right segment, the expansion right segment operably connected to an expansion right side extension, wherein the right segment, the expansion middle segment and the expansion right segment are configured to form a second opening, the second opening so dimensioned and configured as to accept insertion of a second container.

15. The guard of claim 14, wherein the expansion middle segment and the expansion right segment comprise at least one support maintaining a distance of each of the expansion middle segment and the expansion right segment from the supporting surface.

16. The guard of claim 14, wherein the expansion right side extension contacts the supporting surface.

17. The guard of claim 11, wherein the first opening is so dimensioned and configured as to accept insertion of the first container, wherein the first container is a volume selected from the group consisting of 2 yards, 4 yards, 6 yards, 8 yards, 10 yards, 15 yards, 20 yards, 25 yards and 30 yards.

18. The guard of claim 11, wherein each of the left side extension, and the right side extension, comprise a securing plate configured to secure the guard to the supporting surface.

19. The guard of claim 11, wherein first, single length of material is seamless and the second, single length of material is seamless.

20. A guard comprising:

a left side extension operably connected to a left segment;

the left segment operably connected to a left corner;

the left corner operably connected to a middle segment;

the middle segment operably connected to a right corner;

the right corner operably connected to a right segment, wherein the right corner is T-shaped;

the right segment operably connected to a right side extension, wherein the left side extension, the left segment, and the left corner are formed of a first, single length of material, and wherein the right corner, the right segment and the right side extension are formed of a second, single length of material, wherein each of the left segment, the middle segment and the right segment comprise at least one support maintaining a distance of each of the left segment, the middle segment and the right segment from a supporting surface, wherein the left segment, the middle segment and the right segment are configured to form a first opening, the first opening so dimensioned and configured as to accept insertion of a first container, and wherein the at least one support of the left segment is spaced a distance away, towards the at least one support of the right segment, from an apex of the left corner, wherein the at least one support of the right segment is spaced a distance away, towards the at least one support of the left segment, from an apex of the right corner, and wherein the left corner and the right corner are configured such that the middle segment is shorter than a width of the first opening.

* * * * *